US008398299B2

(12) United States Patent
Wiederrecht

(10) Patent No.: US 8,398,299 B2
(45) Date of Patent: Mar. 19, 2013

(54) DISPLAY MECHANISM FOR A TIMEPIECE ENABLING THE CURRENT TIME TO BE DISPLAYED OR NOT DISPLAYED

(75) Inventor: Jean-Marc Wiederrecht, Bernex (CH)

(73) Assignee: La Montre Hermes S.A., Brugg (CH)

( * ) Notice: Subject to any disclaimer, the term of this patent is extended or adjusted under 35 U.S.C. 154(b) by 169 days.

(21) Appl. No.: 13/060,597

(22) PCT Filed: Aug. 21, 2009

(86) PCT No.: PCT/EP2009/060843

§ 371 (c)(1),
(2), (4) Date: Apr. 11, 2011

(87) PCT Pub. No.: WO2010/023169

PCT Pub. Date: Mar. 4, 2010

(65) Prior Publication Data

US 2011/0205854 A1 Aug. 25, 2011

(30) Foreign Application Priority Data

Aug. 26, 2008 (EP) ..... 08105136

(51) Int. Cl.
*G04B 15/00* (2006.01)

(52) U.S. Cl. ..... 368/132

(58) Field of Classification Search ..... 368/18, 368/28, 69–70, 76, 80, 132, 172, 220, 223–238
See application file for complete search history.

(56) References Cited

U.S. PATENT DOCUMENTS 7,646,679 B2 * 1/2010 Gil et al. ..... 368/223
7,706,214 B2 * 4/2010 Scheufele ..... 368/38
7,742,364 B2 * 6/2010 Hiraga et al. ..... 368/80
7,782,717 B2 * 8/2010 Gil et al. ..... 368/69
2008/0151698 A1 6/2008 Gil et al.

(Continued)

FOREIGN PATENT DOCUMENTS

EP 1475681 A1 11/2004
EP 1936447 A2 6/2008
EP 1936448 A2 6/2008
WO 2007/020289 A2 2/2007

OTHER PUBLICATIONS

"Advertisement" La France Horlogere, Societe Millot Et Cie. Besancon, FR, No. 524, Jun. 1, 1991, p. 55, ISSN: 0015-9573, the whole document, Cited in ISR.

(Continued)

*Primary Examiner* — Edwin A. Leon
(74) *Attorney, Agent, or Firm* — Young & Thompson

(57) ABSTRACT

A display mechanism for a clock movement for controlling the movements of a member for displaying at least one indication related to the time or to the operation of a timepiece, includes a cam having a periphery with a predetermined shape and driven by a base wheel, a lever pivotally mounted relative to a frame member of the movement, between an abutment position associated with an indication position of the display member, and a standby position associated with a predetermined alternative position of the display member. The lever bears a feeler intended for interaction with the periphery of the cam so as to define the abutment position, and the lever further bears a rake engaged with a pinion for driving the display member. An elastic element applies a force onto the lever for positioning it in the abutment position. The mechanism includes a mobile control member having at least a stable standby and a stable indication position.

12 Claims, 6 Drawing Sheets

U.S. PATENT DOCUMENTS

| | | | |
|---|---|---|---|
| 2008/0151699 | A1 | 6/2008 | Gil et al. |
| 2009/0040880 | A1 | 2/2009 | Ruchonnet et al. |

OTHER PUBLICATIONS

Sabine Zwettler: "kunstwerke & andere zeitmesser", Uhren Magazin, Jun. 1, 2006, pp. 34-37, Retrieved from the Internet: URL:http://www.pita.es/press/200606-uhrenMagazin.pdf>, [retrieved on Dec. 4, 2009], p. 37, Cited in ISR.

"Benutzer: H. Prescher/Thomas Prescher", Nov. 13, 2009, Retrieved from the Internet: URL:http://de.wikipedia.org/wiki/Benutzer:H._Prescher/_Thomas_Prescher>, [retrieved on Dec. 4, 2009], Paragraphe "Uhren mit retrograder Anzeige", Cited in ISR.

International Search Report, dated Dec. 17, 2009, from corresponding PCT application.

* cited by examiner

DISPLAY MECHANISM FOR A TIMEPIECE ENABLING THE CURRENT TIME TO BE DISPLAYED OR NOT DISPLAYED

TECHNICAL FIELD

The present invention concerns a display mechanism for a timepiece adapted to be driven from a base wheel of a clock movement to actuate the movements of a display device for displaying an indication relative to the time or the operation of the timepiece. In particular, the mechanism according to the invention comprises a cam having a periphery of predefined form and which is adapted to be driven by the base wheel, a lever adapted to be pivotally mounted, with reference to a support member of the clock movement, between an abutment position, associated with an indication position of the display device, and a waiting position, associated with a predefined alternative position of the display device. The lever bears a cam follower adapted cooperate with the periphery of the cam to define the abutment position. The lever furthermore bears a rack arranged in meshing engagement with a pinion adapted to drive the display device, elastic means exerting a force on the lever to bias it into the abutment position.

The present invention also concerns a clock movement and a timepiece provided with such a mechanism.

STATE OF THE ART

Timepieces are known that are commonly called "Bras en l'air" which were produced starting from at the end of the 18$^{th}$ century until the beginning of the 19$^{th}$ century. Only a few tens of specimens are known today, these timepieces not having met with very much success.

These timepieces comprise a movement arranged for retrograde driving of an hour hand and a minute hand, at low gearing over two respective sectors disposed opposite each other, such that they indicate the current time on demand by a user.

To that end, certain known timepieces comprise a pushing member arranged to act on two levers each bearing a rack in meshing engagement with a pinion bearing one of the hands. By default, these levers are disposed in a waiting position associated with a resting position of the hands, typically at midday, under the effect of the action of springs. When the pushing member is actuated by the user, the levers pivot while each driving the corresponding pinion, each pinion being in meshing engagement with a second rack borne by a second lever, the latter also bearing a cam follower adapted to cooperate with the periphery of a cam rotationally driven in time with the minutes, and respectively in time with the hours. When each cam follower is disposed in abutment on the periphery of the corresponding cam, the associated hand indicates the minutes, and respectively the hours, of the current time.

When the user releases the pushing member, the racks return into place under the effect of the action of the springs, the hands returning to midday.

Thus, a main drawback of these timepieces, directly deriving from their purpose, is that they only enable the time to be read on demand.

Furthermore, these timepieces generally had a block, accessible through an opening provided in the dial, to set the time by means of a key. The latter must be manipulated by the user to adjust the time while he must at the same time press on the pushing member to see the effect of his correction, which proves not to be very practical.

A clock movement based on a similar display principle, over 360 degrees, was commercialized more recently by the company Frank Müller and is the subject of patent application EP 1 936 448 A1. The corresponding timepiece displays the time on demand by the user, by pressing on a pushing member.

DISCLOSURE OF THE INVENTION

The main aim of the present invention is to provide a clock movement which makes it possible to produce a timepiece providing an original display, in particular an operating mode in which the time is not displayed, in the same spirit as the timepieces of the prior art described above, while giving the user the possibility of having a time display which is almost conventional.

To that end, the mechanism according to the invention provides the features set out above and further comprises a movable actuating device having at least a waiting position and an indicating position, both being stable positions. This actuating device is arranged to pass alternately from one position to the other in response to successive actions of a user, as well as to oppose the action of the elastic means acting on the lever, in the waiting position, and enable the lever also to assume its waiting position.

By virtue of these features, the display devices may be positioned in each of their possible positions, i.e. of indication and of waiting, in stable manner, that is to say without the user needing to maintain a force on the actuating device to keep the display of the current time.

Although, prima facie, it may seem contradictory to group together these two modes of operation in the same timepiece, this enables the timepieces according to the present invention to be rendered more attractive with regard to the drawbacks of the known timepieces mentioned earlier, while providing the originality thereof.

Thus, the ingenuity of the Applicant has enabled improvements to be made to these timepieces known for over two centuries, which they were lacking until now and which doubtless led to them being virtually abandoned by timepiece manufacturers.

Thanks to the features of the invention cited above, the user has the choice between two stable display modes of the corresponding timepiece, a first in which the display devices indicate the current time, and a second in which they are disposed in a predefined alternative position.

A particular chronograph mechanism is described in the patent application EP 1 475 681 A1, that mechanism being arranged to actuate a display counter of the second fractions measured. A cam is employed to provide the counting of the second fractions, while a cam follower is arranged to cooperate with the periphery of the latter and actuate the movements of the associated display device, uniquely when the measurement of a time is interrupted, to limit the energy requirements of the chronograph mechanism when it is triggered. However, the position of the cam follower is actuated by a column wheel simultaneously actuating the operation of the chronograph mechanism. Thus, not only is the cam only driven when the measurement of a time is triggered, but it must also necessarily be stopped to enable the display, at a given time, of the information that it bears.

The display mechanism according to the present invention arises from a very different approach to that which led to the chronograph mechanism which has just been described.

To be precise, a main aim of the present invention is to enable or not enable, on demand by the user, the display of continuous information relative to the time or relative to the operation of the timepiece, without the value of that information being affected by the fact that it is displayed.

Thus, the display mechanism according to the invention is characterized in that the cam is adapted to be driven continuously, independently of the positions of the movable actuating device and of the lever.

It is preferred for the mechanism to comprise a rocker adapted to be pivotally mounted, with reference to a frame member of the clock movement, and arranged to cooperate with the actuating device, and to cooperate with the lever to neutralize the elastic means when the actuating device is in its waiting position.

Preferably, the actuating device may be of rotary type, for example a column wheel, the rocker having a beak arranged to cooperate with the columns to directly act, by pivoting, on a contact surface of the lever and position it in its waiting position.

By virtue of these additional features, the mechanism according to the invention has a simple structure, with simple assembly and settings, giving high dependability and high reliability of operation.

The predefined alternative position may be a fixed position, defined by the manufacturer on assembly of the timepiece. Alternatively, this predefined position may be associated with the indication by the display device of the value of an additional parameter relating to the time or to the operation of the timepiece.

BRIEF DESCRIPTION OF THE DRAWINGS

Other features and advantages of the present invention will appear more clearly on reading the detailed description of a preferred embodiment that follows, made with reference to the accompanying drawings given by way of non-limiting example and in which.

EMBODIMENT(S) OF THE INVENTION

Figure 1:
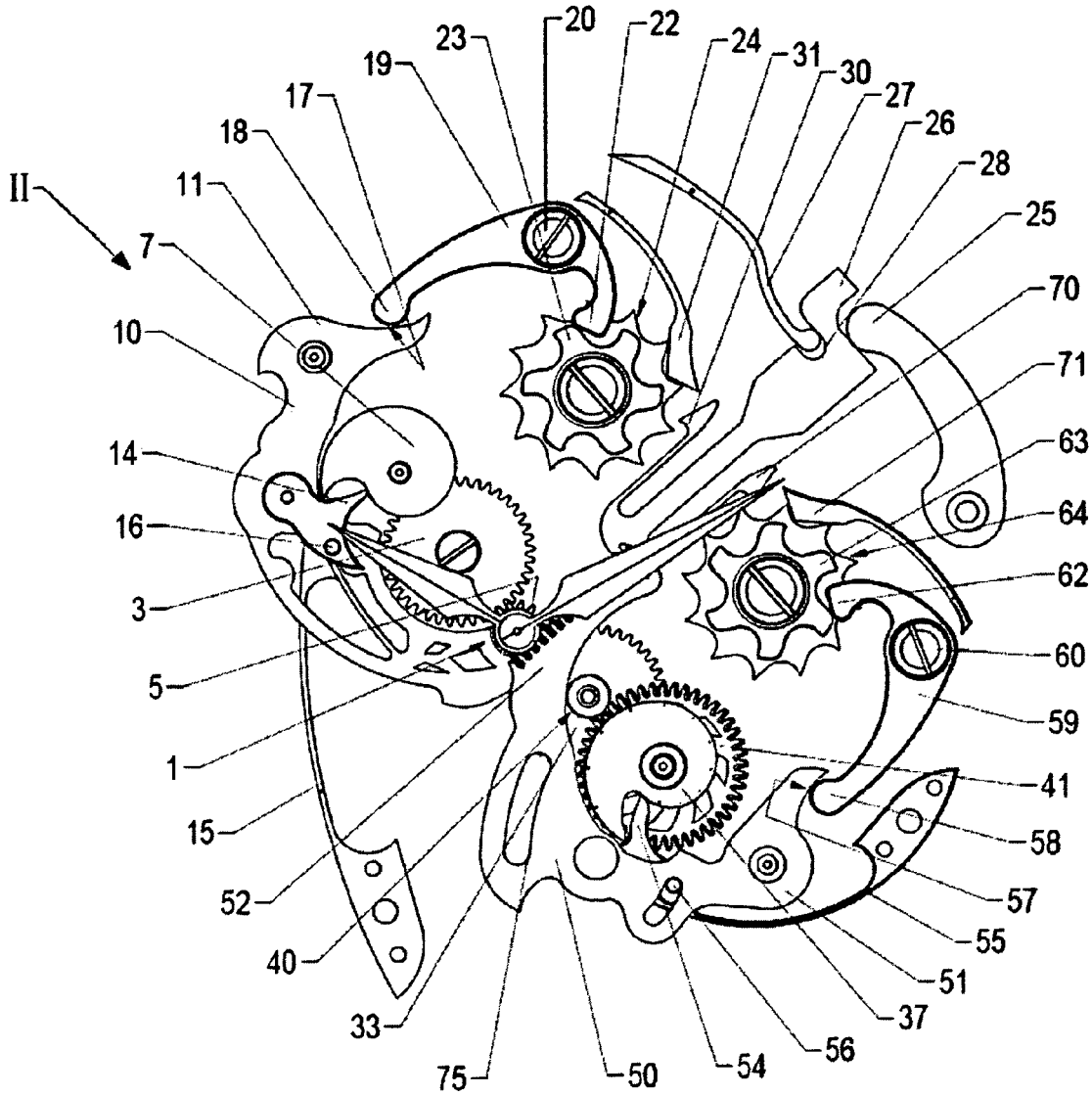
FIG. 1 represents a simplified plan view of a general embodiment of a clock movement comprising a display mechanism according to the invention, in a first configuration.
Figure 2:
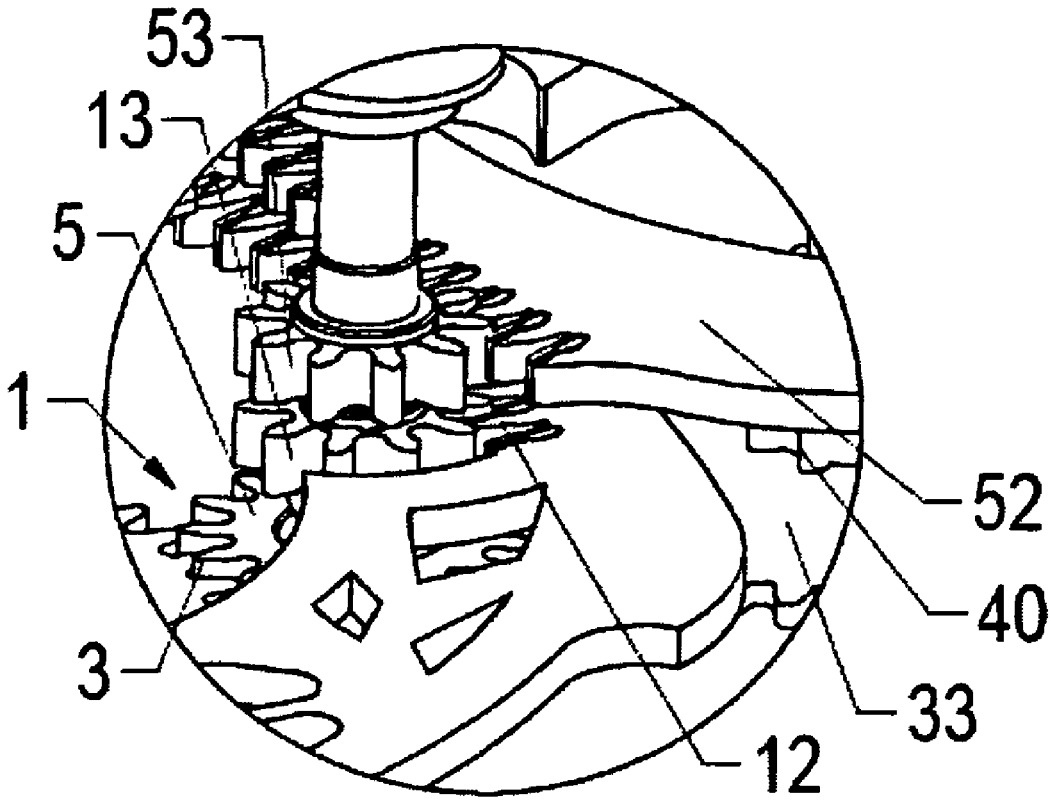
FIG. 2 represents a perspective view of a construction detail of the mechanism of FIG. 1, viewed in the direction of the arrow II of FIG. 1.
Figure 3:
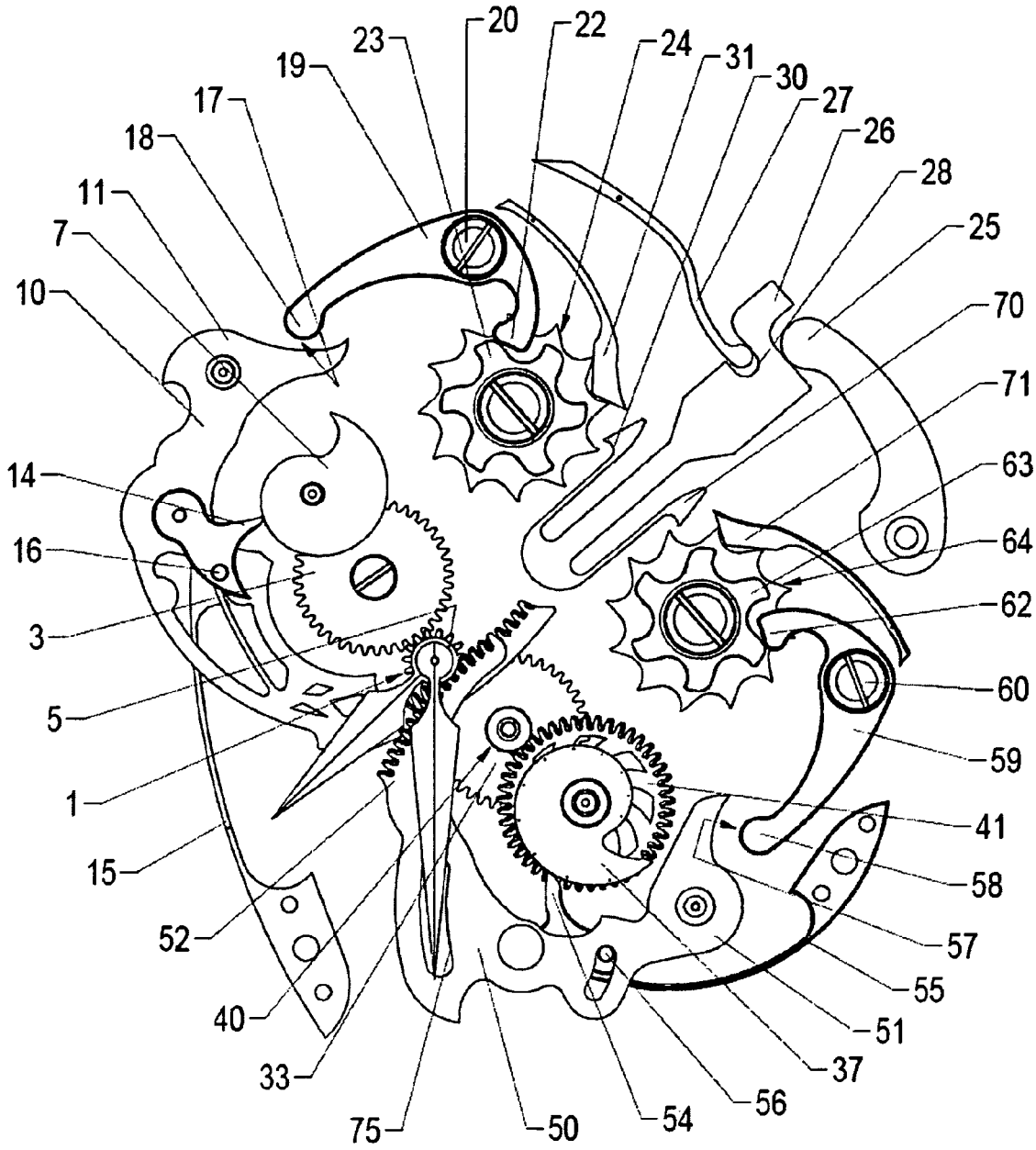
FIG. 3 represents a similar view of the embodiment of FIG. 1, in a second configuration.
Figure 4:
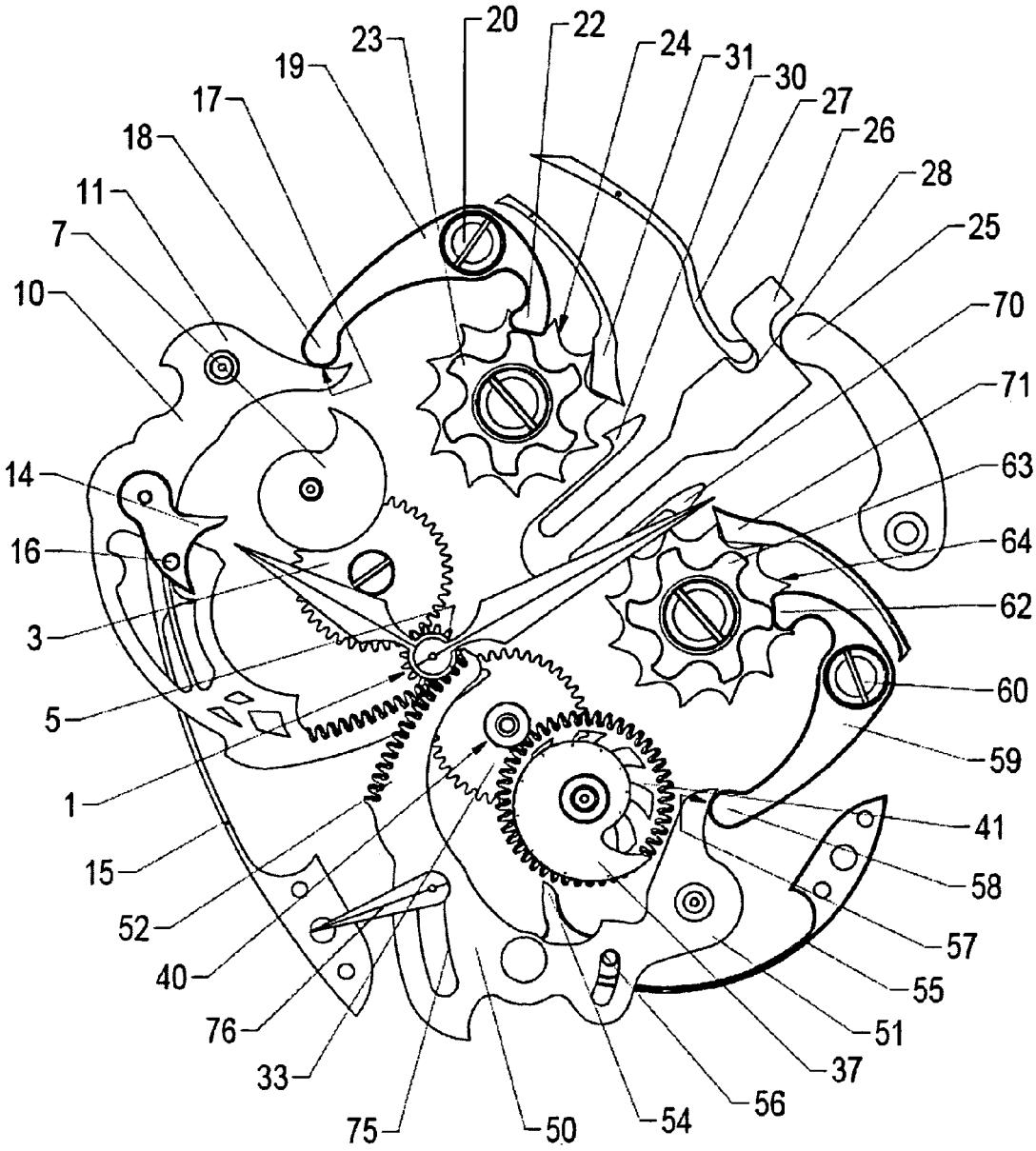
FIG. 4 represents a similar view of the embodiment of FIG. 1, in a third configuration.

In the same simplified plan view, FIGS. 1, 3 and 4 represent a clock movement comprising a display mechanism according to a general embodiment of the invention, respectively in first, second and third configurations. FIG. 2 makes it possible to better understand the interactions that exist between certain components of the mechanism which will be described later.

Certain conventional structural members of the movement have that do not have any direct relation with the invention have not been represented in the drawings, in the interest of clarity.

The movement comprises a plate (not visible) bearing various conventional components including in particular a barrel, a going train and a mechanical resonator not shown.

The movement can be seen from its dial side in the drawings, the display mechanism typically being disposed on this side of the movement.

The display mechanism according to the present invention may be assembled as an integral part of the movement or be added on to a basic movement in the form of a module, as represented in the embodiment which will be described below.

Thus, the display mechanism may comprise an additional plate (not visible in the drawings) fastened to the main plate of the basic movement.

In this case, the additional plate comprises a certain number of holes and openings to enable access to components of the basic movement such as the cannon-pinion 1 for example.

In the upper part of FIGS. 1, 3 and 4, it is apparent that the display mechanism comprises an intermediate wheel 3 arranged in meshing engagement with a pinion 5 of the cannon-pinion 1 and also in meshing engagement with a pinion (not visible) joined to a minute cam 7. The corresponding geartrain is arranged such that the minute cam 7 makes a complete revolution in an hour.

The display mechanism also comprises a minute lever 10 pivotally mounted on the additional plate via a shaft situated in the vicinity of a first of its ends 11. The lever 10 bears a rack 12 (FIG. 2), at its second end, arranged in meshing engagement with a minute pinion 13 (FIG. 2), mounted for free rotation on the cannon-pinion 1 and adapted to bear a display device for the minutes. The lever 10 also bears a cam follower 14, at its median portion. The latter is adapted to cooperate with the minute cam 9 so as to position the minute pinion, via the rack 12, in a position such that the corresponding display device indicates the minutes. The mechanism further comprises a long spring 15 cooperating with a finger 16 mounted on the lever 10 to apply a force thereon biasing the cam follower 14 to press against the periphery of the cam 7.

Furthermore, the minute lever 10 has a contact surface 17, at its first end 11, arranged to cooperate with a first end 18 of a minute rocker 19 which is substantially J-shaped and pivotally mounted on the additional plate by means of a shouldered screw 20 disposed between the two arms of the J.

The second end 22 of the rocker has the shape of a beak arranged to cooperate with the columns 23 of a column wheel 24 rotatably mounted on the additional plate. Thus, when the second end 22 of the rocker 19 is situated in a gap between two columns 23, its first end 18 exerts little or no pressure on the contact region of the first end 11 of the minute lever. The latter is then subject to the action of the long spring 15 tending to maintain the cam follower 14 pressed against the minute cam 7, in order for the minute display device to indicate the minutes of the current time (configurations represented in FIGS. 1 and 3, respectively at 10:10 o'clock and 7:30 o'clock).

Conversely, when the second end 22 of the rocker 19 bears on the column 23, its first end 18 exerts sufficient pressure on the first end 11 of the minute lever to resist the force exerted by the long spring 15. On account of this, the cam follower 14 is moved away from the periphery of the minute cam 7 and the minute lever adopts a predefined alternative position (represented in FIG. 4, here an arbitrary position of the hands at 10:10 o'clock has been illustrated) which in particular depends on the amplitude of rotation of the rocker 19 when it passes from one position to the other. In the embodiment of FIGS. 1 and 3, the predefined position is such that the free end of the cam follower is situated at a distance from the center of the cam 7 greater than the largest radius of the latter. Thus, the cam can make a complete revolution without entering into contact with the cam follower.

In the configuration of FIG. 4, the display device is in a resting position which may be chosen by the manufacturer of the clock movement, at the time of indexing the display device, depending on the manufacturer's preferences or needs.

The column wheel 24 is actuated by means of an actuator having the form of a corrector 26 which may be manipulated by a user from the outside of the corresponding timepiece, using a conventional external device, possibly via a control lever 25, represented by way of non-limiting illustration. The corrector is preferably mounted for free translational movement between two positions, one being a pushed in position and one being a resting position in which it is held, by default, by a corrector spring 27 cooperating with a recess 28 provided in the corrector. The corrector bears a tooth 30 arranged to act on the column wheel 24 when the corrector is pushed in and make it turn through a half-pitch and, consequently to make the rocker 19 pivot from one position to the other. The tooth 30 is preferably elastic to clear out of the way on return of the corrector into its resting position, under the effect of the action of the corrector spring 27.

A jumper 31 has been represented which cooperates with the tooth formation of the column wheel 24 to define the stable positions thereof, in conventional manner.

In the lower part of FIGS. 1, 3 and 4, it is apparent that the display mechanism according to the invention comprises a similar device to that which has just been described, with the aim of controlling the movements of an hour display device.

An intermediate wheel 33 similar to a conventional motion-work to provide the kinematic link between the pinion 5 of the cannon-pinion 1 and the hour cam 37, via its pinion 40 meshing with a wheel 41 rotationally coupled with the cam 37, such that the cam 37 turns once in twelve hours.

The display mechanism comprises an hour lever 50 pivotally mounted on the additional plate via a shaft situated in the vicinity of a first of its ends 51. The lever 50 bears a rack 52, at its second end, arranged in meshing engagement with an hour pinion 53, mounted for free rotation on the cannon-pinion 1, as well as a cam follower 54, at its median portion. The hour pinion 53 performs the function of a conventional hour wheel, that is to say that it is adapted to bear an hour display device. Thus, the cam follower 54 is adapted to cooperate with the hour cam 37 so as to position the hour pinion, via the rack 52, in a position such that the corresponding display device indicates the hours. The mechanism further comprises a long spring 55 cooperating with a finger 56 mounted on the lever 50 to apply a force thereon tending to press the cam follower 54 against the periphery of the cam 37.

Furthermore, the hour lever 50 has a contact surface 57, at its first end 51, arranged to cooperate with a first end 58 of an hour rocker 59 which is substantially J-shaped and pivotally mounted on the additional plate by means of a shouldered screw 60 disposed between two arms of the J.

The second end 62 of the rocker has the shape of a beak arranged to cooperate with the columns 63 of an additional column wheel 64 rotatably mounted on the additional plate. Thus, when the second end 62 of the rocker 59 is situated in a gap between two columns 63, its first end 58 exerts little or no pressure on the contact region of the first end 51 of the hour lever. The latter is then subject to the action of the long spring 55 tending to maintain the cam follower 54 pressed against the hour cam 37, in order for the hour display device to indicate the hours of the current time (configurations represented in FIGS. 1 and 3).

Conversely, when the second end 62 of the rocker 59 bears on the column 63, its first end 58 exerts sufficient pressure on the first end 51 of the hour lever to resist the force exerted by the long spring 55. On account of this, the cam follower 54 is moved away from the periphery of the hour cam 37 and the hour lever adopts a predefined alternative position (represented in FIG. 4) which in particular depends on the amplitude of rotation of the rocker 59 when it passes from one position to the other. In the illustrated embodiment, the predefined position is such that the free end of the cam follower is situated at a distance from the center of the cam 37 greater than the largest radius of the latter. Thus, the cam can make a complete revolution without entering into contact with the cam follower.

As for the minute display device, in the configuration of FIG. 4, the hour display device is in a resting position which may be chosen by the manufacturer of the clock movement, at the time of indexing the display device, depending on the manufacturer's preferences or needs.

The column wheel 64 is actuated by the corrector 26 which bears an additional tooth 70 arranged to act on the column wheel 64 when the corrector is pushed in and to make it turn through a half pitch, and consequently, to make the rocker 59 pivot from one position to the other. The tooth 70 is preferably elastic, as for the tooth 30, to clear out of the way on return of the corrector into its resting position, under the effect of the action of the corrector spring 27.

A jumper 71 is also provided to define the stable angular positions of the column wheel 64.

It should be noted that the form of the periphery of the cams 7, 37 defines the angle traversed by each of the display devices when the movement is in the time display mode. Thus, it is possible to provide for the display devices to move opposite corresponding graduated sectors.

According to a particular embodiment, it is possible to provide for the display devices to traverse graduated sectors extending through an angle of 360°. In this configuration, the current time display is made in practically conventional manner with the exception of the fact that each of the display devices has a retrograde movement after having passed through 360°. By virtue of these features, the appearance of the timepiece may be absolutely conventional, in particular with regard to its dial, in contrast to the timepieces comprising retrograde display devices moving opposite graduated sectors extending over an angle less than 360°.

Furthermore, the travel of the levers 10 and 50 combined with the gear train ratios between the racks 12, 52 and the pinions 13, 53 as well as the indexing of the display devices at the time of their mounting on the movement provide great freedom in the definition of the respective resting positions of these latter. The display devices may be disposed, for example, at midday or at ten past ten which is the position typically used to photograph watch models. It should be noted that, on account of the particular construction of the mechanism according to the invention, the display devices may be totally disconnected from each other and occupy relative resting positions that they never occupy when the timepiece is in current time display mode, such as for example with the two devices superposed pointing exactly to the six o'clock position on a conventional dial.

The display mechanism which has just been described has the advantage of providing an original and discrete display with very high precision and operating reliability.

Figure 5:
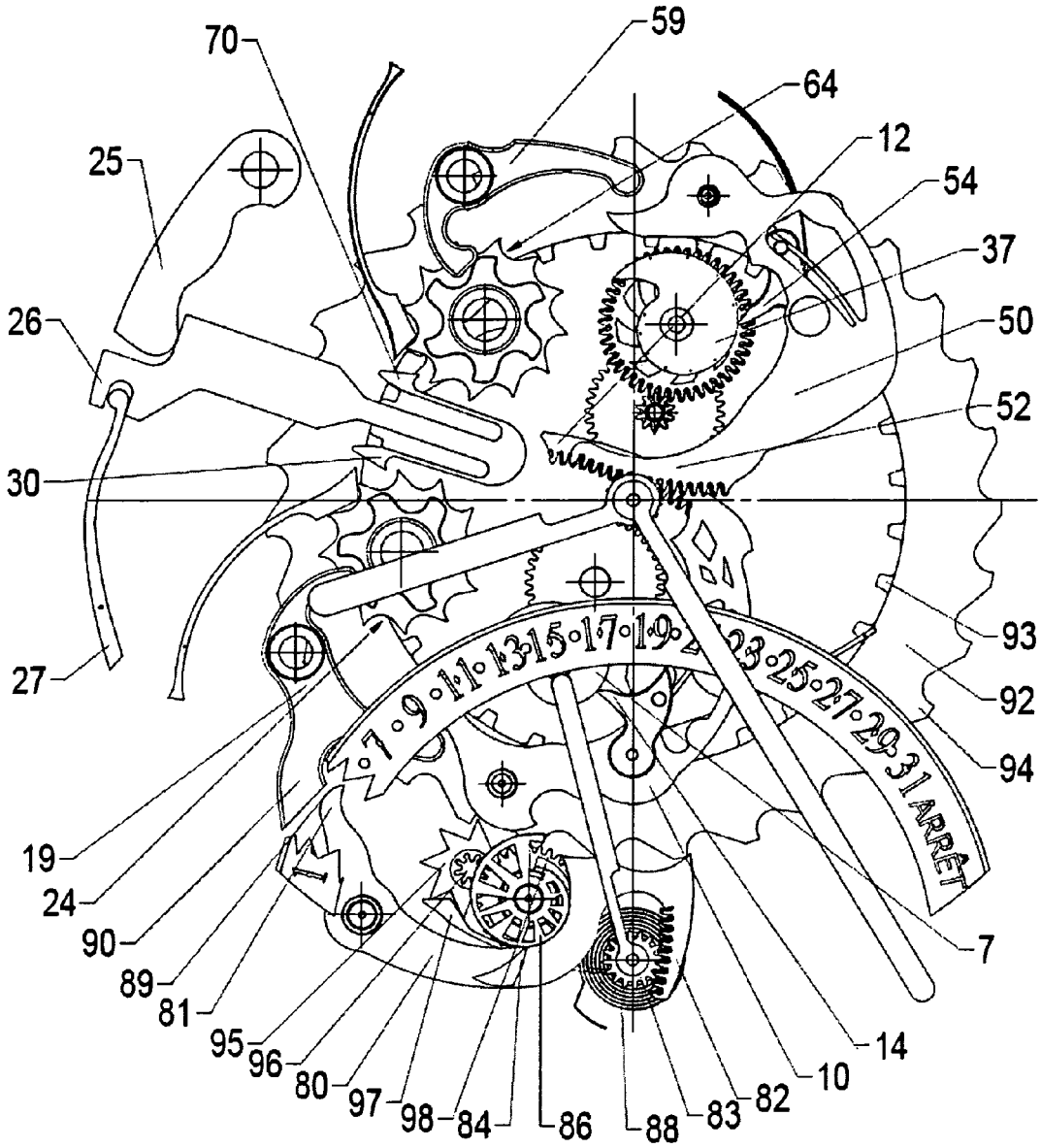
FIG. 5 represents a simplified plan view of a variant embodiment of the clock movement of FIG. 1, in a first configuration.
Figure 6:
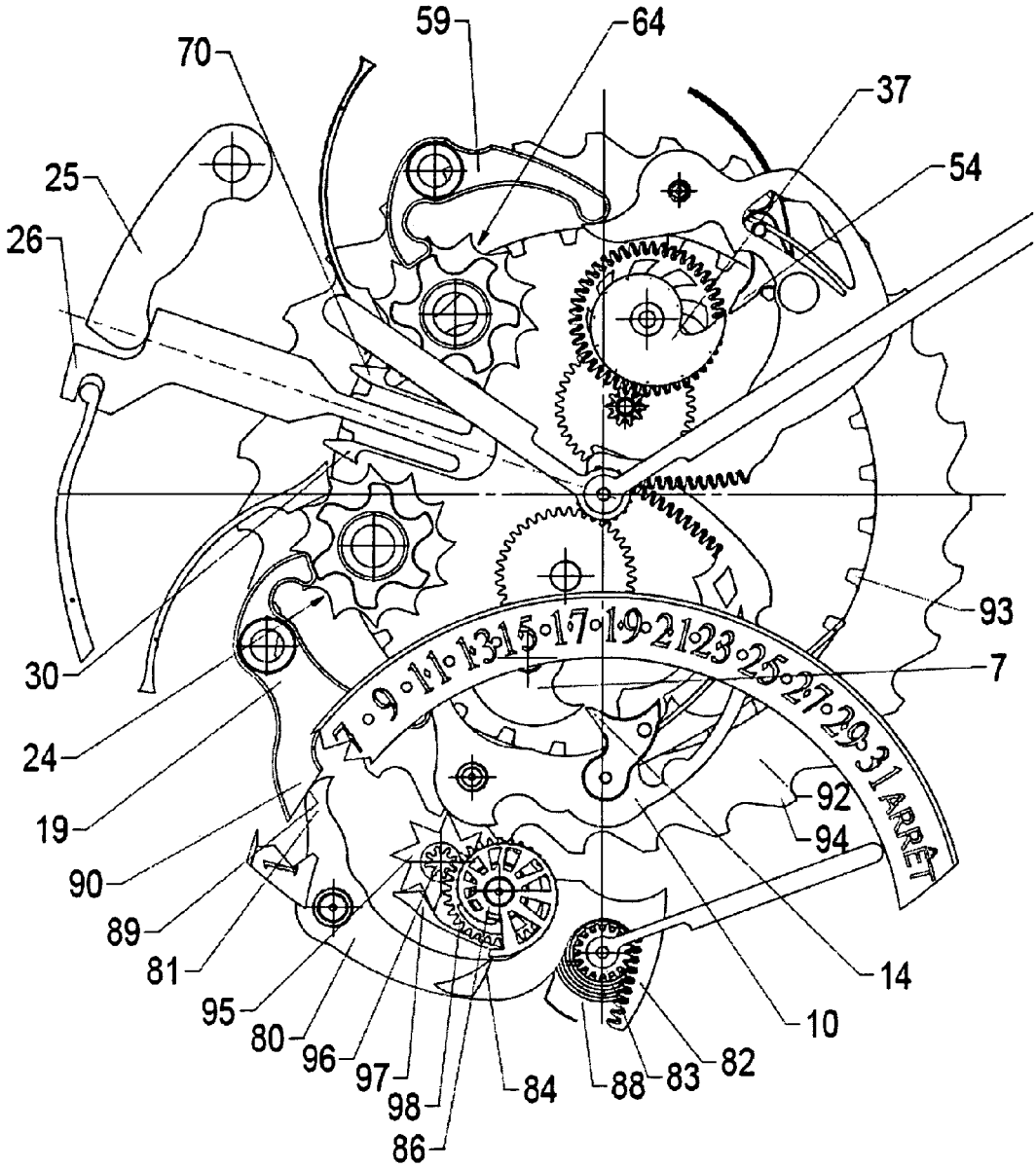
FIG. 6 represents a similar view of the variant embodiment of FIG. 5, in a second configuration.

FIGS. 5 and 6 present a variant embodiment of the main embodiment which has just been described, whereby the display module is furthermore adapted to display additional information, in particular here the day of the month. FIGS. 5 and 6 present a different orientation to that used for the preceding Figures.

To that end, a mechanism with similar structure and operation to those of the indication of the current minutes and hours is provided to control a day of the month display device.

More particularly, the display mechanism described above further comprises a day of the month lever 80 pivotally mounted on the additional plate via a shaft situated in the vicinity of a first of its ends 81. The lever 80 bears a rack 82, at its second end, arranged in meshing engagement with a day of the month pinion 83, mounted for free rotation on the additional plate and adapted to bear a display device for the day of the month. The lever 80 also bears a cam follower 84, at its median portion. The latter is adapted to cooperate, on demand, with a day of the month cam 86 so as to position the day of the month pinion, via the rack 82, in a position such that the corresponding display device indicates the value for the current day of the month. The mechanism further comprises a pre-loaded spiral spring 88, a first end of which is fastened to the additional plate and the second end fastened at least indirectly to the day of the month pinion 83, to bias the latter to turn anti-clockwise (in the drawings) and apply the cam follower 84 against the periphery of the day of the month cam 86.

It should be noted that the cam follower here is made, without this being limiting, in the form of an increased thickness provided on the lever 80, such that the lever may be arranged at a lower level than that of the cam 86. By virtue of this feature, the mechanical properties of the lever may be adapted to the stresses that it must undergo to fulfill its function.

Furthermore, the day of the month lever 80 has a contact surface 89, at its first end 81, arranged to cooperate with an extension 90 carried here by the minute rocker 19. The display of the day of the month is thereby activated or deactivated simultaneously to the display of the current time.

FIG. 5 illustrates the configuration of the clock movement when the display is active whereas FIG. 6 illustrates the configuration corresponding to the suspension of the display, that is to say when the display devices are placed in their respective alternative positions.

The day of the month cam 86 is driven conventionally from a day of the month wheel 92, itself driven from the going train, via an internal tooth formation 93, to go forward one pitch per day. The day of the month wheel also comprises an external tooth formation 94 arranged to advance, by one pitch per day, a star 95 bearing a pinion 96 arranged in meshing engagement with a wheel 98 fastened to the day of the month cam 86. A jumper 97 is provided to correctly position the star 95.

Of course, it is possible as a variant to provide for the day of the month display mechanism to be actuated from the hour display mechanism rather than from that of the minutes, without departing from the scope of the invention.

The preceding description endeavors to describe a particular embodiment by way of non-limiting illustration and the invention is not limited to the implementation of certain particular features which have just been described, such as the column wheels or their form, it being possible alternatively to use rotary actuating devices of shuttle type. Furthermore, a single column wheel may be used without departing from the scope of the present invention, the two rockers then being arranged to cooperate with its columns simultaneously.

As mentioned earlier, the mechanism may be constructed in the form of an additional module adapted to enhance a basic clock caliber or be directly integrated into a clock movement. Similarly, additional and non-coaxial gears may be provided to bear the display devices.

It should be noted that the cam followers 14, 54 have been represented in an optional configuration in the drawings, more particularly they are rotatably mounted on the corresponding lever while they bear the fingers 16, 56 on which the straight springs 15, 55 act. Such a configuration, providing security in case the user were to set the time by turning the cams 7, 37 in the anti-clockwise direction in the drawings, is conventional and should not be considered to be limiting.

Similarly, a curved recess 75 has been provided in the hour lever 50, without this being limiting, to enable the passage of a shaft adapted to bear a second hand 76, as is apparent in FIG. 3.

As a complement to the general embodiment which has been described, it is possible to provide for the mechanism to comprise additional means in order for at least one of the levers 10, 50 to have a second abutment position, associated with the resting position of the corresponding display device, in which that device will be able to display an additional parameter relative to the time or to the operation of the timepiece.

Furthermore, it is also possible to provide that the display of additional information, as illustrated in FIGS. 5 and 6, may be implemented in relation to information other than the day of the month. It may in particular be provided to indicate other parameters, such as the day of the week or the month, alternatively or in addition to the display of the day of the month as described. Of course, when at least two kinds of additional information are displayed, their respective mechanisms may respectively be actuated from the display mechanisms for the hours and for the minutes.

The person skilled in the art will have no particular difficulty in adapting the content of the present disclosure for his own requirements and in producing a time piece having an exclusive display without departing from the scope of the present invention.

The invention claimed is:

1. A display mechanism for a timepiece, adapted to be driven from a base wheel (1, 5) of a clock movement to actuate the movements of a display device for displaying at least one indication relative to the time or the operation of the timepiece, the mechanism comprising a cam (7) having a periphery of predefined form and which is adapted to be driven by the base wheel, a lever (10) adapted to be pivotally mounted, with reference to a support member of the clock movement, between an abutment position, associated with an indication position of the display device, and a waiting position, associated with a predefined alternative position of the display device, said lever bearing a cam follower (14) adapted to cooperate with the periphery of said cam to define said abutment position, the lever furthermore bearing a rack (12) arranged in meshing engagement with a pinion (13) adapted to drive the display device, a movable actuating device (24) having at least a waiting position and an indicating position, both being stable positions, said actuating device being arranged to pass alternately from one position to the other in response to successive actions of a user, elastic means (15) exerting a force on said lever to bias it into said abutment position, said actuating device also being arranged to oppose the action of said elastic means (15) in its waiting position and enable said lever (10) to assume its waiting position, characterized in that said cam is adapted to be driven continuously, independently of the positions of said movable actuating device and of said lever.

2. A mechanism according to claim 1, characterized in that it comprises a rocker (19) adapted to be pivotally mounted, with reference to a frame member of the clock movement, and arranged to cooperate with the actuating device (24), and to cooperate with said lever (10) to oppose the action of said elastic means (15) when said actuating device is in its waiting position.

3. A mechanism according to claim 2, characterized in that said actuating device is a rotary actuating device (24).

4. A mechanism according to claim 3, characterized in that said actuating device is a column wheel (24), said rocker (19) having a beak (22) arranged to cooperate with the columns (23) to directly act, by pivoting, on a contact surface (17) of said lever (10) and position it in its waiting position.

5. A mechanism according to claim 1, characterized in that it is arranged such that a complete revolution of said cam (7) is associated with at least one complete revolution of said display device.

6. A mechanism according to claim 1, characterized in that said display device is an indicator device of the hour or of the minute.

7. A mechanism according to claim 1, characterized in that the base wheel (5) of the clock movement is driven by a cannon-pinion (1) to make one revolution in one hour, said display device being a minute display device, the display mechanism further comprising an additional cam (37) adapted to be driven from the clock movement to make one revolution in twelve or twenty-four hours, an additional lever (50) cooperating with said additional cam and bearing an additional rack (52) arranged in meshing engagement with an additional pinion (53) to drive an hour display device, additional elastic means (55) to act on said additional lever, said actuating device (24) being arranged to oppose the action of said additional elastic means in its waiting position and to enable said additional lever (50) also to assume a waiting position associated with a predefined alternative position of the hour display device, simultaneously with its action on the lever (10) associated with the display of the minutes.

8. A mechanism according to claim 1, characterized in that the base wheel (5) of the clock movement is driven by a cannon-pinion (1) to make one revolution in one hour, said display device being a minute display device, the display mechanism further comprising an additional cam (37) adapted to be driven from the clock movement to make one revolution in twelve or twenty-four hours, an additional lever (50) cooperating with said additional cam and bearing an additional rack (52) arranged in meshing engagement with an additional pinion (53) to drive an hour display device, additional elastic means (55) to act on said additional lever, an additional movable actuating device (64) having at least a waiting position and an indicating position, both being stable positions, said actuating device being arranged to pass alternately from one position to the other in response to successive actions of a user, the positions of the additional actuating device being coordinated with those of the actuating device (24) that is associated with the display of the minutes, the additional actuating device (64) being arranged to oppose the action of said additional elastic means (55) in its waiting position and to enable said additional lever (50) also to assume a waiting position associated with a predefined alternative position of the hour display device.

9. A mechanism according to claim 8, characterized in that it comprises an actuator (26) adapt to be actuated by a user via an external device and which is arranged to act simultaneously on said actuating device (24) and on said additional actuating device (64) to make them change position.

10. A mechanism according to claim 7, characterized in that said pinion (13) and said additional pinion (53) are superposed.

11. A clock movement comprising a base wheel (1, 5) arranged to drive at least one cam (7, 37) of a display mechanism according to claim 1.

12. A timepiece comprising a clock movement according to claim 11 arranged to drive at least one display device.

* * * * *

UNITED STATES PATENT AND TRADEMARK OFFICE

CERTIFICATE OF CORRECTION

PATENT NO. : 8,398,299 B2
APPLICATION NO. : 13/060597
DATED : March 19, 2013
INVENTOR(S) : Jean-Marc Wiederrecht It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 213 days.

Signed and Sealed this
First Day of September, 2015

Michelle K. Lee

Michelle K. Lee
*Director of the United States Patent and Trademark Office*